United States Patent [19]

Watts

[11] 4,443,109

[45] Apr. 17, 1984

[54] METHOD AND APPARATUS FOR CONTINUOUS FEEDING, MIXING AND BLENDING

[75] Inventor: Robert H. Watts, North Bend, Ohio

[73] Assignee: Vol-Pro Systems, Inc., Centerville, Ohio

[21] Appl. No.: 303,874

[22] Filed: Sep. 21, 1981

[51] Int. Cl.[3] ..... B01F 15/04

[52] U.S. Cl. ..... 366/134; 222/132; 222/413; 222/457; 366/153; 366/156; 366/162; 366/186

[58] Field of Search ..... 366/153, 154, 155, 156, 366/157, 160, 162, 169, 173, 9, 341, 134, 186; 222/132, 145, 138, 139, 413, 457

[56] References Cited

U.S. PATENT DOCUMENTS

| | | | |
|---|---|---|---|
| 618,734 | 1/1899 | Ross | 222/457 |
| 858,017 | 6/1907 | Pence | 366/155 |
| 1,834,670 | 12/1931 | Yett | 222/132 |
| 3,051,454 | 8/1962 | Goos | 366/156 |
| 3,964,650 | 6/1976 | Lau | 222/457 |
| 4,201,484 | 5/1980 | Sasiela | 366/153 |

*Primary Examiner*—Robert W. Jenkins

*Attorney, Agent, or Firm*—Wood, Herron & Evans

[57] ABSTRACT

Apparatus and method for automatically and continuously feeding, blending and mixing particulate material. In a non-mixing mode, a primary material is gravity fed through a vertical flow tube disposed in a chamber. Material flows into the chamber until an equilibrium level is established within the chamber. The volume of material fed through the system is governed by the through-put of a take-off screw, which communicates with a port in the bottom of the chamber. In a mixing mode, secondary materials, such as additives, are metered into the chamber at a point above the equilibrium mixing level, which secondary materials are mixed with the primary material, thereby automatically proportioning the final product feed. The vertical flow tube can be rotatable about its longitudinal axis in either mode to enhance mixing and feeding.

45 Claims, 3 Drawing Figures

METHOD AND APPARATUS FOR CONTINUOUS FEEDING, MIXING AND BLENDING

BACKGROUND OF THE INVENTION

This invention relates to a feeding and a mixing or blending apparatus and method, and more particularly to an apparatus and method for automatically and continuously blending and mixing quantities of particulate material of a granulated, powdered, or pelletized quality. At the outset it should be appreciated though that while the invention is described as applied to a mixing or blending apparatus, it is equally advantageous for use as a pure feeding mechanism exclusive of any mixing or blending functions.

In the production of finished molded plastic products from injection, blow and extrusion molding and like procedures, it is common to mix different types of raw materials together in predetermined quantities to produce a proper blend for the molding process. The polymeric materials generally employed will be in the form of dry particulate material of a granulated, powdered, or pelletized quality, the final blend being typically a combination of these various raw materials. For example, in a typical injection molding process, several different types of plastic in the form of virgin polymer, a reground polymeric material recovered from scrap, and a colorant or like additive are mixed together in a fixed ratio before being fed to an injection molding apparatus. The ratio of the materials making up the final feed blend is often of critical importance, since the quality and consistency of the finished product can be altered with even minor variances in the constituent materials making up the feed product. Raw materials must thus be precisely measured out in the correct amounts, and homogeneously mixed and blended to yield a feed which will maintain the desired ratio throughout the course of a continuous production run.

Where batch mixing is employed, the ability to make a homogeneous mix is of no particular difficulty, since thorough mixing of the combined materials is usually effected before the batch is progressed through the system. When using a continuous production operation, however, it is often difficult to precisely blend the various raw materials before the feed passes through the mixing area to a take-off which in turn communicates with and delivers the final product feed to the molding apparatus. Unless properly blended, undesirable concentrations of several constituent materials may be maintained in the final product feed, thus yielding a non-uniform finished product. The accurate and thorough mixing and blending of the disparate materials making up the final feed is thus a highly desired feature for any continuous mixing apparatus.

Maintaining the proper ratio of raw materials in the product feed is often difficult. Many prior art devices employ systems which entail the addition of a separate and additional metering apparatus for each material which is to be added to the final product feed, each metered product being delivered to a central chamber for mixing together. Each additional metering system adds an additional factor of potential error and required control into the mixing of the final feed. This becomes more important where one of the constituents making up the final feed predominates, which is the usual case. Metering of the predominant quantity can entail the use of a larger metering device capable of handling the larger quantity, or a faster feed rate in smaller metering equipment with a concomitant greater potential for error in producing the requisite volume of material for the final feed blend. Further, such equipment often uses a force feed principle for metering out the desired quantities of raw materials. These force feed processes typically pneumatic or vacuum induced, further degrade the accuracy and control of the final feed blend; the mechanical movement of the disparate materials is undesirable, since such automatic metering mechanisms will operate regardless of the amount of material actually present in the system, the raw material being fed being typically subject to blockages, unequal flow rates, or other discontinuities of flow which will not be detected by the automatic force feed devices.

Some prior art devices have attempted to overcome these difficulties in part by applying a gravity feed to the major constituent of the feed product. The major or primary raw material is generally deposited into a hopper/mixing chamber combination, additives being metered into the chamber for mixing with the primary material. Mixing of the various raw materials within the hopper/mixing chamber may occur through use of a stirring mechanism disposed within the hopper/mixing chamber, or within a plasticizing or take-off screw which ordinarily is in communication with the end port of the chamber. It should be noted that mixing and blending effected only by a plasticizing or take-off screw is often undesirable, since a localized concentration of a raw material may not be removed in the course of the screw feed, thus producing a non-homogeneous feed for the final product.

The hopper/mixing chamber device, although eliminating a major metering operation, nevertheless suffers from several infirmities. First, the material being directly added to the hopper/mixing chamber is subject to bridging and rat-holing, which will affect the regular flow of material through the take-off screw. Further, the flow rate of the screw can be affected by the pressure and load factors presented by the raw material in the hopper. The amount and bottom density of material in the hopper will thus affect the amount of material being drawn off by the take-off screw. That is, more material in the hopper will increase the pressure on, and thus the density of, the material at the withdrawal point of the screw. The flow of material from the take-off screw may thus significantly vary depending on the amount of material in the hopper.

Given that it is highly desirable to carry out mixing and accurately supplying the raw materials on an automated and continuous basis to achieve a maximum production rate with the least amount of manual intervention and control, it can be seen that there is a need in the industry for a device which can reduce the amount of direct metering of raw materials by gravity feeding the primary constituent, but do it in such a way that a constant blend of materials is maintained at a constant flow rate that is not affected by the amount of raw material in the primary hopper.

An object of the instant invention is therefore to provide an apparatus and method which are capable of automatically, accurately and continuously combining a primary material, such as a particulate virgin feed, with an additive material, such as a colorant and/or regrind particulate scrap, where the combined materials are potentially of different physical character, and to do so with an unmetered gravity feed of the primary raw material directly to the mixing chamber in such a manner as to insure the constant flow of feed with the proper ratio of blended raw materials to a discharge mechanism, the load imposed on the discharge mechanism and the density of material at the discharge point remaining relatively constant.

Another object is to provide an apparatus and method which are capable of continuously feeding one or more particulate materials to a discharge mechanism in such a manner as to insure a constant density of a given material or materials at the discharge mechanism, as well as a constant load on the discharge mechanism.

SUMMARY OF THE INVENTION

The apparatus and method of the instant invention accomplishes the above described desired feeding, mixing and blending by providing in one preferred embodiment that the primary constituent of the product feed (e.g., virgin pellets, powdered PVC, etc.) is gravity fed from a hopper through a rotating vertical flow tube or shaft having lateral openings at its base and an internal flow deflector, the tube being located axially within a mixing chamber. The volume of material fed through the system is governed by the through-put of the take-off screw, which communicates with the bottom port of the mixing chamber. The flow tube permits the gravity induced flow of primary material from the hopper through the tube and into the mixing chamber until an equilibrium point is reached where the material within the tube is counterbalanced by the build-up of material in the hopper, thus preventing further outflow from the tube until material within the mixing chamber is removed by the take-off screw.

In the mixing or blending mode of operation of the invention, secondary materials, such as regrind, colorant or other additives, are metered into the mixing chamber at a point above the equilibrium mixing level of the system, dropping via gravity to the maintained mixing level. The secondary materials figure into the equilibrium level, serving to displace the primary gravity-fed material, thus automatically proportioning the ultimate mixture. The secondary materials metered into the mixing chamber are each correlated to the through-put established for the take-off screw. Due to the displacement effected by the secondary additives, the system advantageously provides a simple and direct ability to determine the amounts of raw materials to be admitted to the mix to make the desired ratio for the final product feed. Additive is simply metered out in the exact quantity desired per unit of time for the output product feed; the primary gravity-fed material is thereby automatically and accurately proportioned.

Mixing blades are fixedly attached to the rotating flow tube to enhance displacement of the various materials being admitted to the chamber to insure a homogeneous mix of materials being fed to the take-off screw. The flow tube establishes a constant volume and level of material within the mixing chamber, thereby maintaining a constant pressure and load on the take-off screw which prevents bridging, rat-holing, and an unequal flow rate of the product feed.

Since a constant density of material will be maintained at the outlet port of the mixing chamber due to the equilibrium level effected, there is no overfeed or underfeed of product feed from the plasticizing or take-off screw. Used in a non-mixing mode, i.e. as a pure feeder with only primary material being admitted to the chamber via the flow tube, the apparatus performs as a feeding device for the take-off screw. In this feeding-only mode, the invention advantageously establishes a constant volume and level of material within the chamber, thereby maintaining a constant pressure and load on the take-off screw which prevents bridging, rat-holing and an unequal flow rate of the product feed.

The system is advantageously designed with standard auger and feed tube diameters, and employs DC gear motors for the various auger, screw and rotary shaft drives. The auger-type feeder preferably employed is generally capable, in the commercial embodiment, of feed rates from 0.05 g./sec. to 1,000 lb./hr. Where additive must be admitted to the mix at a rate less than the minimum attainable with the standard equipment available, a preliminary step can be employed whereby the additive is compounded with another additive to form a meterable compound. The apparatus in general provides atthroat mounting, quick cleaning and color change, and visual monitoring of the mixing chamber. The method and apparatus can be advantageously applied for mixing and blending in the chemical, food products, and pharamaceutical areas, among others.

The various drives are preferably all operated from a common switch or control device to insure the proper coordination and operation of the variously driven parts of the mixer. Although the mixer is particularly adapted for use with an extrusion, blow or injection molding device, it is obviously capable of thoroughly feeding, mixing and blending materials in general for other applications. Likewise, the materials capable of being advantageously fed and mixed by this invention are not limited to the aforementioned polymeric and thermoplastic materials, the practice of the present invention being adaptable to uniformly blending and feeding whole grain products, confections, flours, fertilizers, pulverized stone, and the like.

In a further embodiment of the invention, a flow tube is mounted in a mixing chamber such that an equilibrium level is established in the chamber. Primary material maintained in a central hopper is gravity fed through the flow tube into the chamber to establish the equilibrium level, material thereafter flowing in response to the material being removed via the discharge mechanism. Additive is metered into the chamber in the previously described manner, automatically proportioning the material being withdrawn from the chamber. The flow tube maintains a constant density and level of material in the chamber that places a constant pressure and load on the discharge mechanism insuring an accurate rate of flow of material from the discharge mechanism, while also serving to prevent bridging and rat-holing. This application of the flow tube for the primary feed is equally adaptable to the hoppers typically employed with the metering devices. In this latter application, a flow tube is mounted in an additive hopper bottom such that an equilibrium level is established in a chamber in the feeder housing surrounding the auger feed mechanism generally employed. Additive maintained in the hopper is gravity fed through the flow tube to the chamber, where an equilibrium level is established, additive thereafter flowing only in response to the material being removed via the auger. The constant density of material and load presented to the auger insures an accurate rate of flow of additive and a more precise metering of additive, while also preventing bridging and rat-holing at the hopper/auger interface.

The various objects and advantages of this invention will become more apparent upon reading the following detailed description of the preferred embodiments that is made with reference to the accompanying drawings which are:

DETAILED DESCRIPTION OF THE DRAWINGS

Figure 1:
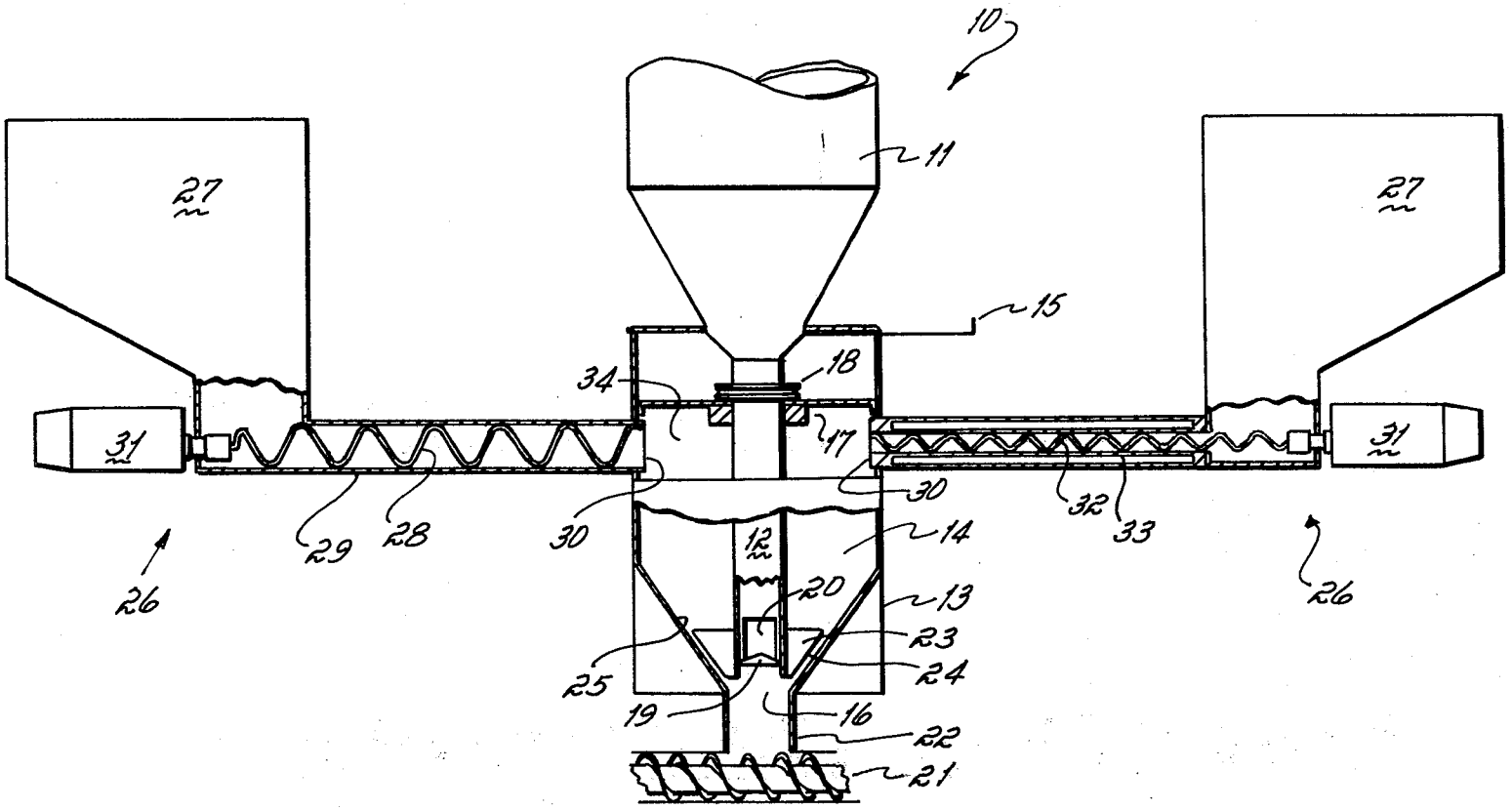
FIG. 1 is a diagrammatic elevational view of the principal embodiment of the invention, partially cutaway for detail.

Referring to FIG. 1, the feeding, blending and mixing apparatus of this invention is generally indicated at 10. The apparatus includes a central, fixed primary hopper 11 which communicates with an elongated flow tube 12. The hopper 11 will typically contain the primary constituent of the product feed to be ultimately produced by the mixer, such as a pelletized virgin resin or powdered PVC. The hopper is mounted on a housing or framework 13 which contains the mixing chamber 14. A shut-off gate 15 is provided near the base of the primary hopper 11 to prevent material from flowing from the hopper 11 into the flow tube 12 when required, such as when the mixer is to be cleaned. The gate is generally rectangular with a circular hole therein of even diameter with the hopper at that point, and is manually reciprocated within a way (not shown) between open and closed positions, the closed position merely interjecting a solid sheet transverse to the hopper outlet, thus interrupting the flow of primary material into the tube 12.

The mixing chamber 14 is generally cylindrical at the top, gradually tapering radially inwardly and downwardly to form an exit port 16. The flow tube 12 is rotatably fixed within the housing 13 by a support 17, and is axially positioned along the central axis of the mixing chamber 14, with the outlet of the tube just above the port 16. A belt drive (not shown) is provided for driving a pulley 18 fixed to the tube 12 for rotating the tube about its longitudinal axis. In this embodiment, the tube 12 is continuously rotated during the entire mixing procedure; however, the speed of rotation is not critical to the practice of this invention, although it should not be so great as to centrifuge primary material within the tube. It will be immediately obvious that, although this particular embodiment employs a rotating flow tube, an equivalent effect can be achieved by fixing the flow tube and rotating the chamber in relation thereto.

A generally conical shaped deflection plate 19 is mounted transversely in the outlet end of the tube 12 to deflect the flow of primary material coming down the tube 12 laterally into the mixing chamber 14 through two opposed cut-out portions 20 in the bottom of the tube 12. The lateral deflection of the material from the tube 12 facilitates the intermingling of the various raw materials admitted to the mixing chamber 14, since the rotating tube will deliver the primary material in a swirling motion within the chamber. The deflection plate 19 further prevents the direct flow of primary material through the port 16 to the take-off screw 21, since particulate material, because of its laminar flow tendencies, tends to move preferentially through a limited area concentric with the vertical axis of the mixing chamber in the area of the port.

A take-off screw 21 extends below the port 16 and is separated from the port by a small vertical channel 22 through which the material mixed in the chamber 14 flows. This take-off screw 21 may be a feed screw for a plastic molding machine, a plasticizing screw for an extruding apparatus, or simply a product feed screw; a product feed screw would be employed where the invention is used as a compounding apparatus and method, for example. The take-off screw 21 operates as a plug for the outlet of the mixing chamber, preventing the flow of material out of the mixing chamber except in response to the removal of material therefrom via the take-off screw.

Primary material flowing from the hopper 11 down through the flow tube 12 will initially be deflected outwardly into the mixing chamber 14 through the lateral cut-outs 20. The mixing chamber 14 will thereupon fill up until an equilibrium level is established where the build-up of the primary particulate material in the mixing chamber 14 prevents the further flow of material out from the flow tube 12, the tube in effect becoming clogged by material within the chamber. This equilibrium will be governed in part by the type of material being employed, its particulate size, shape and general texture. For the general run of materials being processed through the primary hopper, e.g. virgin resin pellets or powdered PVC, an equilibrium level will ordinarily be established at a point at or just below the top of the lateral cuts 20. For any given primary material, this equilibrium level will remain constant, and is virtually independent of the quantity of material maintained within the primary hopper 11. As a consequence, the density and weight of material present at the take-off screw 21 remains constant, thus preventing both overfeeding and underfeeding by the take-off screw 21, effectively preventing bridging and rat-holing within the mixing chamber, and generally guaranteeing an equal flow rate of product feed. Further, by introducing the primary material into the mixing chamber 14 via gravity feed alone, the principal constituent of the final product feed is thereby accurately and continuously fed in an unmetered state. This reduces the error ordinarily encountered where mechanical metering of this constituent is employed.

Two radially extending mixing blades 23 are fixedly mounted on the bottom or outlet end of the tube 12 in this embodiment to further enhance the inherent mixing effected by the rotating tube, by mechanically displacing or stirring the material within the mixing chamber 14. In this preferred form, the two blades 23 have outer edges 24 which roughly conform to the configuration of the radially inwardly and downwardly tapered chamber bottom 25, and which are slightly spaced from the same to prevent possible wedging caused by larger and irregular material in the chamber, such as regrind. In the event the further mixing or blending is required or desired, a high intensity mixer (not shown) may be employed at a point below the lower end of the tube.

In a non-mixing mode, the invention functions as a feeding mechanism for the discharge means possessing the advantages herebefore discussed. Used as such a pure feeder, primary material simply flows through the flow tube 12 into the mixing chamber 14 until an equilibrium level is established; primary material thereafter flows into the chamber 14 only in response to the withdrawal of material from the chamber. The apparatus may employ a rotating tube or rotating chamber in this non-mixing mode, blades 23 being employed to agitate the primary material in the chamber 14; however, it is equally advantageous to perform this feeding-only function without any such tube or chamber rotation.

In a mixing mode, secondary materials, such as colorant, blowing agent and regrind plastic, are fed into the mixing chamber 14 by metering devices generally indicated at 26. The number of secondary metering devices 26 that may be used for the simultaneous addition of different types of raw materials is not limited by this invention; however, most commercial adaptations of this invention will commonly require only two or three secondary material additives to be mixed with the primary material.

Each metering device 26 in this embodiment consists of a second hopper 27 of standard form, which is placed in direct connection with a feed screw or auger 28, 32. The auger 28, 32, is contained within a feed tube 29, 33 which has its distal end 30 mounted to the housing 13 at a point above the equilibrium level of material. Standard auger designs and feed tube diameters are employed, differing augers and/or tubes being used as required or desired. For example, a larger auger 28 may be desired for feeding a typical large particulate regrind raw material, while a smaller auger 32 in a smaller diameter tube 33 may be advantageously employed for feeding a granular or powdered additive.

The distal end 30 of the feed tube 29, 33 extends slightly within the housing 13 so as to deliver additive material from the auger feed to the mixing chamber to a point slightly inwardly from the near edge of the mixing chamber. The additive is subject to a relatively small vertical displacement via gravity from the distal end 30 of the feed tube 29, 33 to the surface level of the equilibrium mix. The introductory point of the additive is not deemed significant, however, so long as the additive is admitted to the chamber at a point above the surface level of the equilibrium mix. It will be recognized that the type of metering device employed in this invention is not restricted to an auger type, which has been described herein for purposes of illustration of the best mode, but includes other metering devices, such as gravimetric, waybelt, etc.

The feed tube 29, 33 with its associated second hopper 27 is fixedly and generally perpendicularly mounted to the side of the housing 13, and may have supporting struts (not shown) as required. A standard drive motor 31, such as a 115 V single phase 1.3 amp gear motor, is mounted at one end of the feed tube 29, 33 to provide the motive force for the auger feed, and each motor 31 is calibrated via reference motor speed controls for variable metering of secondary material. Additive will thus be deposited on the surface of the equilibrium level established within the mixing chamber and will be mixed with the primary gravity fed material by virtue of the rotary action of the flow tube 12 and mixing blades 23 and the downward flow of material being drawn off by the take-off screw 21. Additive will consequently displace an amount of primary material equal to the additive introduced, thereby proportionately reducing the flow of primary material from the flow tube 12 since the equilibrium level initially established remains constant on the average. This advantageously yields a quick and simple method for calibrating the quantities of the various raw materials which are to make up the final feed product. For example, assuming that a 100 g. mold capacity is to be filled by a 2 second charge and the desired percentage composition of the final product is 20% regrind, 5% colorant, and 75% primary virgin plastic material, the mixing apparatus of this invention would be set as follows: the plasticizing unit will be set to deliver 100 g. of material in the space of two seconds; the regrind will be set to be metered into the mixing chamber at 10 g./sec.; the colorant at 2.5 g./sec. By virtue of the displacement of these additives and the equilibrium mix maintained within the mixing chamber, the balance of the charge will be of primary material, which will be delivered from the flow tube at the rate of 37.5 g./sec., the rate of flow of primary material thus being equal to the rate of removal of the mixed materials less the combined flow rates of the additives.

The drives for the metering devices 26, the rotary flow tube 12, and the take-off screw 21, are each preferably controlled in common to coordinate feeding of additive with mixing and removal of mixed material so as to consistantly produce the desired proportions of raw materials in the final feed product.

It will be noted that the take-off screw 21 does not perform any essential function in terms of actual mixing or blending of the raw materials, the latter operation being performed within the confines of the mixing chamber 14 as previously described. However, the take-off screw 21 operates as the flow control means for the primary material admitted through the flow tube 12, since the gravity fed primary material will only flow into the mixing chamber 14 in response to the removal of mixed materials from the chamber.

As is shown in FIG. 1, the preferred embodiment provides for an open vertical separation 34 between the top of the mixing chamber 14 and the support 17. This yields the advantageous ability to directly observe mixing. The metering devices 26 are also preferably mounted at the level of this vertical separation 34 to facilitate observation of the function of the outlet portions of the same. Both the mounting of the metering devices 26 in this area and the open vertical separation 34 are matters of choice, however, and are not limitations on the practice of this invention.

Figure 2:
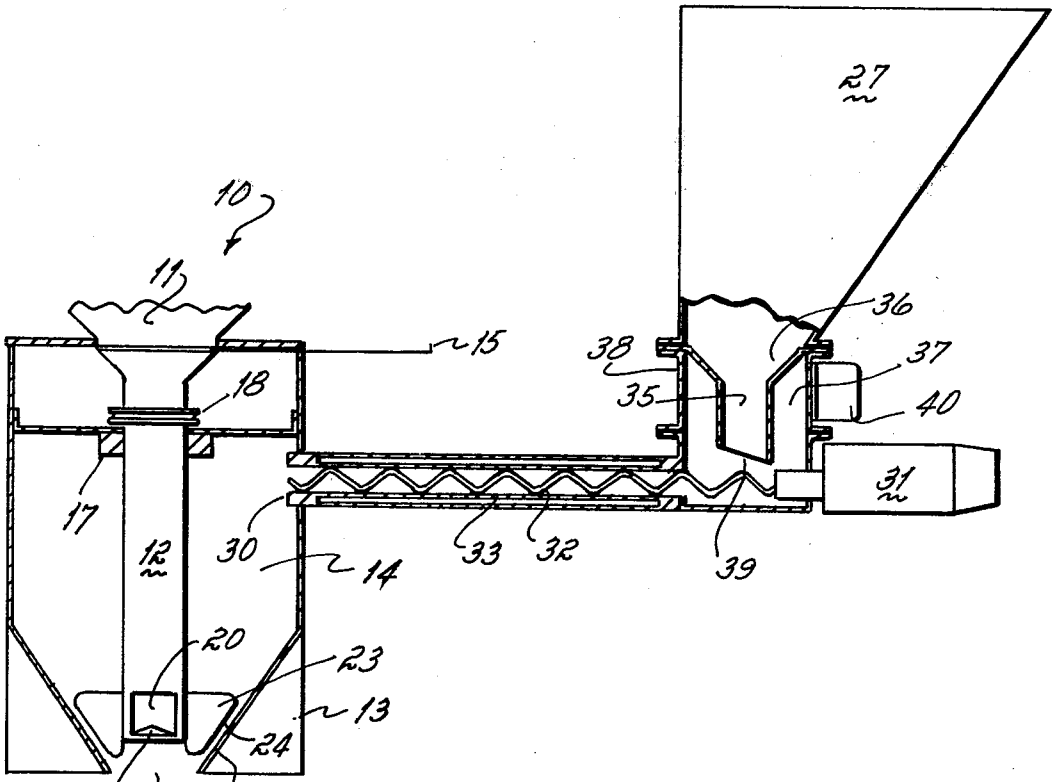
FIG. 2 is a diagrammatic elevational view of an additional embodiment showing a flow tube in an additive hopper.

An adaption of the instant invention contemplates the employment of a flow tube as previously described, but which is used in conjunction with the second hopper 27 and associated auger feed. As shown in FIG. 2, a flow regulator tube 35 is fixed within the throat 36 of the second hopper 27 immediately above the auger 32. An outer chamber 37 is left in the feeder housing 38 surrounding the flow regulator tube 35. Additive deposited in the hopper 27 falls via gravity through the tube 35 and fills the chamber 37 until an equilibrium level is established within the chamber 37, the material in the chamber 37 balancing the flow of materials from the tube 35, effectively clogging the latter. With powdered additives, the equilibrium level will typically be established at or near the level of the tube opening 39. As is shown, the tube opening 39 has been angled to provide for a greater depth of material near the first full turns of the auger 32. The flow regulator tube 35 maintains a constant density and level of material within the chamber 37 upon which the auger 32 acts, producing a constant pressure and load on the auger 32 which prevents bridging, rat-holing, and an unequal flow rate of the metered material. A vibrator motor 40 may be attached for hopper agitation where fine or granular particulate materials are involved to facilitate a steady flow of material from the hopper to the flow regulator tube 35.

Figure 3:
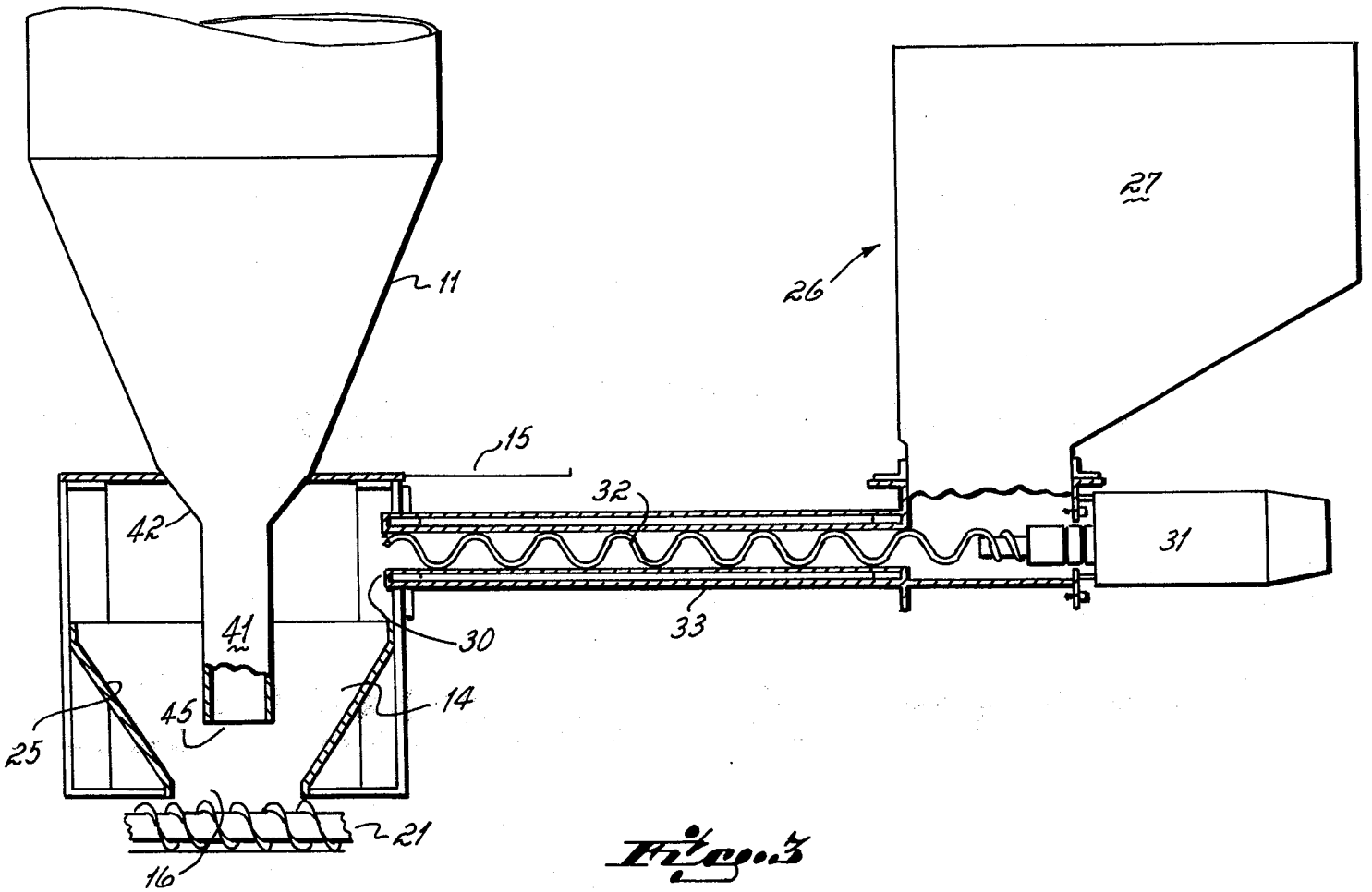
FIG. 3 is a diagrammatic elevational view of an additional embodiment showing a flow tube for primary material in a mixing chamber.

An additional embodiment of the invention is shown in FIG. 3, and is particularly adapted for low additive volume proportioning applications. A flow regulator tube 41 is fixed within the throat 42 of a primary hopper 11, extending below the primary hopper 11 into a mixing chamber 14. The open end 45 of the tube is maintained at a point above the exit port 16 of the chamber 14; the exit port directly communicates with a discharge mechanism, such as the take-off screw 21 depicted.

Primary material deposited in the hopper 11 is gravity fed through the flow tube 41 into the chamber 14 until a sufficient volume and denisty of material builds up within the chamber which prevents further flow from the tube 41 into the chamber 14. This equilibrium level that is established will typically be at an elevation generally even with the tube opening 45. Primary material within the chamber 14 is thereafter maintained at this equilibrium level, a volume of material flowing into the chamber 14 in response to an equal volume of material being withdrawn from the chamber 14 via the take-off screw 21. The flow tube 41 thus maintains a constant density and level of material in the chamber 14 that places a constant pressure and load on the take-off screw 21, insuring a constant flow of material from the take-off screw 21 while also serving to prevent bridging and rat-holing of the material.

Applied in a proportioning and limited mixing mode, one or more additive metering devices 26 can be employed as previously described so as to supply secondary material to the mixing chamber 14. Here, as in the previously disclosed embodiment of this invention of FIG. 1, the secondary material metered into the chamber 14 automatically proportions the material in the chamber 14 by displacing primary material, the primary and secondary material thereby additively forming the constant equilibrium level maintained within the chamber 14.

While I have described my invention with reference to preferred embodiments, persons skilled in this art will appreciate numerous changes and modifications which may be made without departing from the spirit of my invention. Therefore I do not intend to be limited except by the scope of the following appended claims.

I claim:

1. An apparatus for mixing and blending solid particulate materials, comprising:

a mixing and blending chamber, said chamber having a downwardly sloping bottom wall, a port at the lower end of said bottom wall, a vertical flow tube having an upper and lower end, said tube having a vertical axis, support means for rotatably supporting said tube for rotation about said axis within said chamber, agitating means mounted on said tube for agitating materials in said chamber, drive means to rotate said tube about said vertical axis, an opening in said tube at its lower end, deflecting means adjacent the lower end of said tube for radially deflecting material toward said agitating means, a first source of primary feed material communicating with said tube to admit primary material to said chamber for mixing, a second source of secondary feed material communicating with said chamber at a point above said opening in said tube, means for metering said secondary material into said chamber, discharge means for receiving and feeding said first and secondary feed materials away from said chamber, said discharge means being below said port, whereby said primary material flowing through said rotating tube and said secondary material being metered into said chamber are mixed together within said chamber prior to flowing through said port to said discharge means.

2. The apparatus of claim 1 wherein said opening in said tube is a lateral opening, said deflecting means being in said tube for radially deflecting material through said opening.

3. The apparatus of claim 1 wherein the rate of metering of said secondary material and the rate of discharge effected by said discharge means are such that an equilibrium mixing level is established and maintained within said chamber.

4. The apparatus of claim 3 wherein said metering means, said discharge means and said rotating means are coordinated.

5. The apparatus of claim 1 wherein said vertical axis of said flow tube is aligned with said port.

6. The apparatus of claim 1 wherein said means for metering said secondary material consists of an auger feed tube.

7. The apparatus of claim 6 wherein said auger feed tube extends substantially perpendicularly to said chamber, its distal end set inwardly beyond the nearest edge of said chamber, said distal end being above the level of mixing within said chamber.

8. The apparatus of claim 1 wherein said agitating means comprises at least one blade fixed to the side of said tube.

9. The apparatus of claim 8 wherein said blade has an outer edge which conforms to the inner contour of said chamber in the area of agitation.

10. The apparatus of claim 1 wherein said lower end of said vertical flow tube is above and adjacent said port, said deflecting means being adjacent said port.

11. The apparatus of claim 10 wherein said deflecting means is a plate fixed within said tube transverse to the flow of material within said tube.

12. The apparatus of claim 11 wherein said deflecting means is generally conical in shape, the apex of said cone extending upwardly within said tube.

13. The apparatus of claim 11 further comprising a second and identical lateral opening in said tube located on the opposite side of said tube.

14. The apparatus of claim 11 wherein said primary and secondary materials are thermoplastic materials.

15. The apparatus of claim 11 wherein said primary and secondary materials are polymeric materials.

16. The apparatus of claim 1 wherein said discharge means is a take-off screw.

17. An apparatus for homogeneously mixing and blending two or more particulate materials comprising a mixing chamber, said mixing chamber being generally cylindrical with an open top and a radially inwardly and downwardly sloping bottom, said bottom terminating at its center in an open port, a housing for said chamber, a central flow tube having an upper and lower end positioned within said housing, said tube being longitudinally co-axial with said chamber and port, and having its lower end adjacent said port, support means on said housing for rotatably fixing said tube within said housing, drive means to rotate said tube upon its axis,
at least one lateral opening in said tube adjacent its lower end,
flow deflecting means transversely fixed within said tube adjacent said lower end,
at least one blade fixed to said tube for agitating materials in said chamber,
a first feed hopper on said housing, said first hopper communicating with said tube to admit, via gravity feed, primary material to said chamber for mixing,
a second hopper for secondary material,
an auger feed tube for metering said secondary material into said chamber from said second hopper, said auger feed tube extending substantially horizontally through said housing with its distal end above the mixing level maintained in said chamber,
discharge means for said chamber, said discharge means being below said port,
whereby said primary material flowing through said rotating tube and said secondary material being metered into said chamber reach an equilibrium level in said chamber when said discharge means is in operation.

18. An apparatus for homogenously mixing and blending two or more particulate materials comprising
a mixing and blending chamber, said chamber having a downwardly sloping bottom wall,
a port at the lower end of said bottom wall,
a vertical flow tube having an upper and lower end, said tube having a vertical axis,
support means for supporting said tube within said chamber,
agitating means for agitating materials in said chamber,
an opening in said tube at its lower end,
deflecting means adjacent the lower end of said tube for radially deflecting material toward said agitating means,
a first source of primary feed material communicating with said tube to admit primary material to said chamber for mixing,
a second source of secondary feed material communicating with said chamber at a point above said opening in said tube,
means for metering said secondary material into said chamber,
discharge means for receiving and feeding said first and secondary feed materials away from said chamber, said discharge means being below said port,
whereby said primary material flowing through said tube and said secondary material being metered into said chamber are mixed together within said chamber prior to flowing through said port to said discharge means.

19. The apparatus of claim 18 further including means for effecting relative rotation between said tube and said chamber.

20. The apparatus of claim 19 wherein said agitating means is fixed within said chamber.

21. The apparatus of claim 20 wherein said agitating means comprises at least one blade.

22. An apparatus for feeding solid particulate material, comprising:
a chamber, said chamber having a downwardly sloping bottom wall,
a port at the lower end of said bottom wall,
a vertical flow tube having an upper and lower end, said tube having a vertical axis,
an opening in said tube at its lower end,
a source of primary feed material communicating with said tube to admit said primary material to said chamber for feeding,
discharge means for receiving and feeding said primary material from said chamber, said discharge means being below said port,
means for establishing an equilibrium level of solid particulate material within said chamber above the level of said opening in said lower end of said tube so that after establishment of said equilibrium level material flows through said flow tube into said chamber only in response to the removal of material from said chamber by said discharge means.

23. The apparatus of claim 22 further comprising agitating means for agitating materials in said chamber.

24. The apparatus of claim 23 further comprising support means for rotatably supporting said tube for rotation about said axis within said chamber, and drive means to rotate said tube about said axis.

25. The apparatus of claim 24 wherein said agitating means comprises at least one blade extending outwardly from said tube.

26. The apparatus of claim 24 further comprising deflecting means adjacent the lower end of said tube for radially deflecting primary material toward said agitating means.

27. The apparatus of claim 24 wherein said deflecting means is a plate fixed within said tube transverse to the flow of primary material within said tube.

28. The apparatus of claim 22 wherein said discharge means is a take-off screw.

29. The apparatus of claim 22 further comprising a second source of secondary feed material communicating with said chamber at a point above said opening in said tube at its lower end, and means for metering said secondary material into said chamber, whereby said primary material and said secondary material reach an equilibrium level within said chamber.

30. A material flow regulator for particulate material, comprising
a chamber,
a discharge means for said chamber,
a source of primary feed material,
a source of additive material,
a tube, said tube extending above said discharge means and below said primary source of material, such that material in said primary source may flow relatively unobstructed from said primary source through said tube and to said discharge means via gravity, said tube extending within said chamber,
means for admitting said additive material to the chamber, and
means for establishing an equilibrium level of particulate material in said chamber, such that after establishment of said equilibrium level said primary material flows through said tube only in response to the removal of material from said chamber by said discharge means.

31. The apparatus of claim 30 wherein said discharge means is a generally horizontally disposed take-off screw.

32. The apparatus of claim 31 wherein said tube is angularly cut at its lower discharge end.

33. The apparatus of claim 30 wherein said tube is vertically disposed.

34. The apparatus of claim 30 wherein said source of additive material communicates with said chamber at a point above said equilibrium level.

35. The method for homogeneously mixing and blending particulate said materials in a chamber, said chamber having a downwardly sloping bottom terminating in a discharge port and discharge means located below said port, comprising the steps of providing a vertical flow tube axially centered in said chamber, said flow tube having agitating means at its lower end, charging a primary material into said tube from a source, laterally displacing said primary material from said tube at its lower end into said chamber, metering secondary material at a controlled rate into said chamber above the level of mixing maintained within said chamber, rotating said tube about its longitudinal axis, discharging mixed material from said chamber, whereby said primary and secondary materials reach an equilibrium level in said chamber, said gravity fed material thereby being charged into said chamber only in response to the discharge of material from said chamber.

36. The method of claim 35 wherein said primary and secondary materials are thermoplastic materials.

37. The method of claim 35 wherein said primary and secondary materials are polymeric materials.

38. The method for continuously feeding solid particulate material from a source of particulate material into a chamber, said chamber having a discharge mechanism, comprising the steps of providing a flow tube for said source, said flow tube extending above said discharge mechanism and below said source, supplying material to said tube from said source in a continuous manner, said material flowing through said tube into said chamber and to said discharge mechanism via gravity, agitating the material within said chamber, and establishing an equilibrium level of solid particulate material in said chamber, said material after establishment of said equilibrium level flowing through said tube only in response to the removal of material from said chamber by said discharge means.

39. The method of claim 38 wherein said tube has agitating means fixed adjacent one end, and wherein agitation is effected by rotating said tube about its longitudinal axis.

40. The method of claim 38, further comprising the step of metering a second particulate material into said chamber, said second material being metered into said chamber at a point above said equilibrium level.

41. An apparatus for feeding solid particulate material, comprising:

a chamber, said chamber having a downwardly sloping bottom wall, a port at the lower end of said bottom wall, a vertical flow tube having an upper and lower end, said tube having a vertical axis, an opening in said tube at its lower end, a source of primary feed material communicating with said tube to admit said primary material to said chamber for feeding, discharge means for receiving and feeding said primary material from said chamber, said discharge means being below said port whereby said primary material flowing through said tube into said chamber reaches an equilibrium level within said chamber, agitating means for agitating materials in said chamber, support means for rotatably supporting said tube for rotation about said axis within said chamber, and drive means to rotate said tube about said axis.

42. An apparatus for feeding solid particulate material, comprising:

a chamber, said chamber having a downwardly sloping bottom wall, a port at the lower end of said bottom wall, a vertical flow tube having an upper and lower end, said tube having a vertical axis, an opening in said tube at its lower end, a source of primary feed material communicating with said tube to admit said primary material to said chamber for feeding, discharge means for receiving and feeding said primary material from said chamber, said discharge means being below said port whereby said primary material flowing through said tube into said chamber reaches an equilibrium level within said chamber, a second source of secondary feed material communicating with said chamber at a point above said opening in said tube at its lower end, and means for metering said secondary material into said chamber, whereby said primary material and said secondary material reach an equilibrium level within said chamber.

43. A material flow regulator for a source of particulate material, comprising, a chamber, discharge means for said chamber, a tube, said tube extending above said discharge means and below said source, such that material in said source may flow relatively unobstructed from said source through said tube and to said discharge means via gravity, said tube extending within said chamber, whereby said material reaches an equilibrium level in said chamber, said material thereafter flowing through said tube only in response to the removal of material from said chamber by said discharge means, a second source of additive particulate material, said second source communicating with said chamber at a point above said equilibrium level, and means for metering said second source of additive material into said chamber, whereby said particulate materials combine to make said equilibrium level.

44. The method for continuously feeding solid particulate material from a source of particulate material into a chamber, said chamber having a discharge mechanism, comprising the steps of providing a flow tube for said source, said flow tube extending above said discharge mechanism and below said source, supplying material to said tube from said source in a continuous manner, said material flowing through said tube into said chamber and to said discharge mechanism via gravity, whereby said material reaches an equilibrium level in said chamber, said material thereafter flowing through said tube only in response to the removal of material from said chamber by said discharge means, said tube having agitating means fixed adjacent one end, and wherein agitation is effected by rotating said tube about its longitudinal axis.

45. The method for continuously feeding solid particulate material from a source of particulate material into a chamber, said chamber having a discharge mechanism, comprising the steps of providing a flow tube for said source, said flow tube extending above said discharge mechanism and below said source, supplying material to said tube from said source in a continuous manner, said material flowing through said tube into said chamber and to said discharge mechanism via gravity, whereby said material reaches an equilibrium level in said chamber, said material thereafter flowing through said tube only in response to the removal of material from said chamber by said discharge means, and metering a second particulate material into said chamber, said second material being metered into said chamber at a point above said equilibrium level.

* * * * *

UNITED STATES PATENT AND TRADEMARK OFFICE

CERTIFICATE OF CORRECTION

PATENT NO. : 4,443,109

DATED : April 17, 1984

INVENTOR(S) : Robert H. Watts

It is certified that error appears in the above-identified patent and that said Letters Patent is hereby corrected as shown below:

Column 8, line 52 "materials" should be --material--.

Column 13, line 5 "said" should be --solid--.

Signed and Sealed this

Second Day of October 1984

[SEAL]

*Attest:*

GERALD J. MOSSINGHOFF

*Attesting Officer*

*Commissioner of Patents and Trademarks*